US008100557B2

(12) United States Patent
Chen et al.

(10) Patent No.: US 8,100,557 B2
(45) Date of Patent: Jan. 24, 2012

(54) LED LIGHTING MODULE WITH LARGE LIGHT EMITTING ANGLE

(75) Inventors: Chin-Chung Chen, Taipei Hsien (TW); Hai-Wei Zhang, Shenzhen (CN); Ci-Jin Mo, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 250 days.

(21) Appl. No.: 12/545,037

(22) Filed: Aug. 20, 2009

(65) Prior Publication Data

US 2010/0328938 A1 Dec. 30, 2010

(30) Foreign Application Priority Data

Jun. 24, 2009 (CN) ..... 200910303591.9

(51) Int. Cl.
*F21V 33/00* (2006.01)

(52) U.S. Cl. ..... 362/249.02; 362/296.01; 362/346

(58) Field of Classification Search ..... 362/227, 362/235, 237, 240, 241, 244, 245, 249.01, 362/249.02, 249.11, 299, 327, 328, 346, 362/347, 395, 404, 405, 410, 433, 543–546, 362/800

See application file for complete search history.

(56) References Cited

U.S. PATENT DOCUMENTS

| | | | | |
|---|---|---|---|---|
| 7,093,958 | B2 * | 8/2006 | Coushaine | 362/249.02 |
| 7,204,608 | B2 * | 4/2007 | Beeman et al. | 362/233 |
| 7,255,467 | B2 * | 8/2007 | Ishida et al. | 362/520 |
| 7,722,220 | B2 * | 5/2010 | Van De Ven | 362/294 |
| 7,905,634 | B2 * | 3/2011 | Agurok et al. | 362/296.01 |
| 2003/0016536 | A1 * | 1/2003 | Lin | 362/250 |
| 2003/0063476 | A1 * | 4/2003 | English et al. | 362/545 |

* cited by examiner

*Primary Examiner* — Hargobind S Sawhney
(74) *Attorney, Agent, or Firm* — Altis Law Group, Inc.

(57) ABSTRACT

An LED lighting module includes a base, a plurality of first LEDs disposed on a top side of the base, and a plurality of reflectors disposed on the top side of the base. The reflectors correspond to the first LEDs, respectively, whereby light generated by the first LEDs can illuminate an area to which a bottom side of the base faces. A plurality of second LEDs are disposed on the top side of the base and located within the reflectors.

18 Claims, 6 Drawing Sheets

LED LIGHTING MODULE WITH LARGE LIGHT EMITTING ANGLE

BACKGROUND

1. Technical Field

The disclosure relates to illumination devices and, particularly, to an LED (light emitting diode) lighting module with a large light emitting angle.

2. Description of Related Art

LED lighting devices have been quickly developed in recent years. Compared with traditional lighting sources, the advantages of the LED lighting devices are small volume, short response time, long life, low driving voltage and better anti-shock capability. Traditionally, the LED lighting device is manufactured through two general optical design processes to form primary and secondary optical systems. The primary optical system generally refers to a transparent resin package covering an LED chip. The primary optical system functions to efficiently extract light out of the LED chip by controlling a distribution of luminous intensity of the emitted light. The secondary optical system is generally constructed by lenses, reflectors, or other optical structures, to optimize the distribution of luminous intensity of the light emitted from the primary optical system.

A light emitting angle of a traditional LED lighting device is less than 120°. When the traditional LED lighting device is applied in carbarn, mine or the like sites which need a three-dimensional illumination effect. Therefore, the traditional LED lighting device having small light emitting angle can not meet this big scale illumination demand.

What is needed, therefore, is an LED lighting module with a large light emitting angle which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
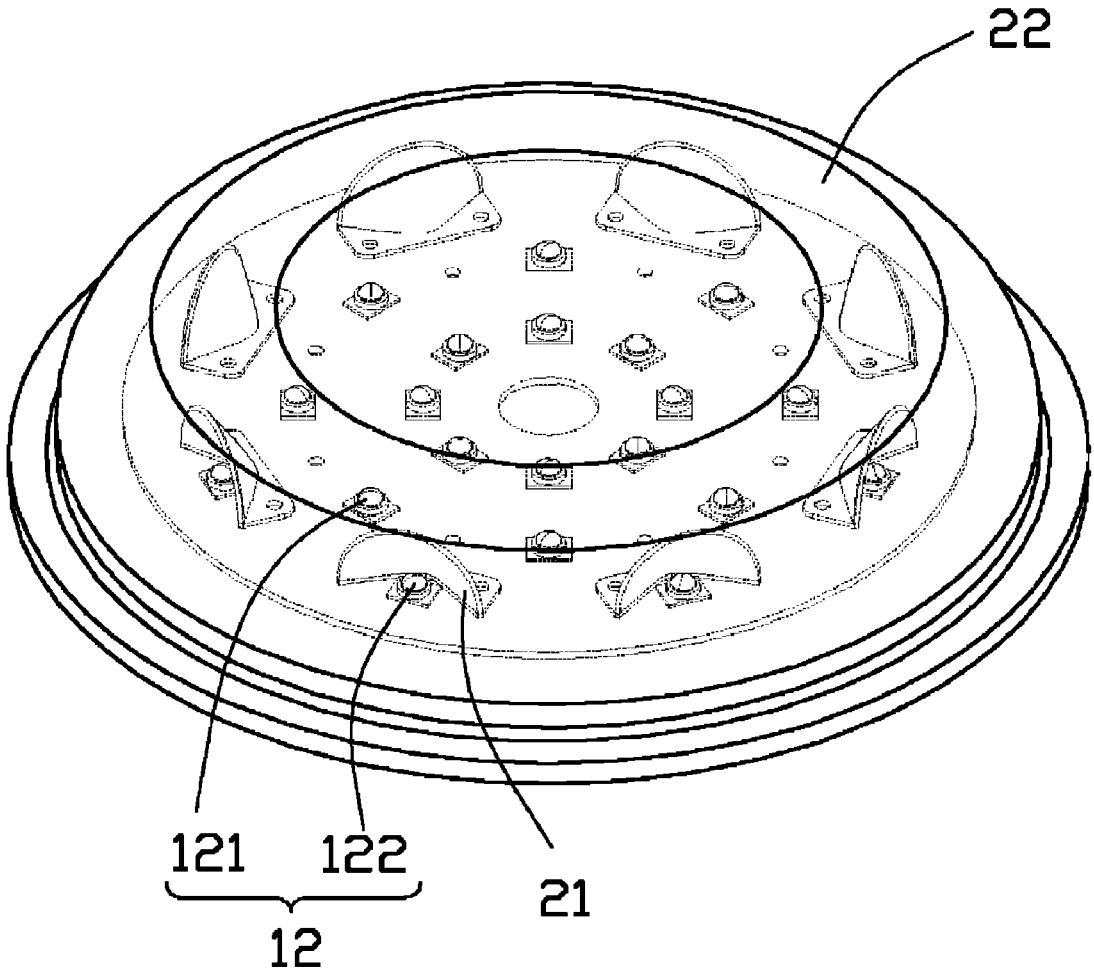
FIG. 1 is an assembled view of an LED lighting module in accordance with an embodiment of the disclosure.
Figure 2:
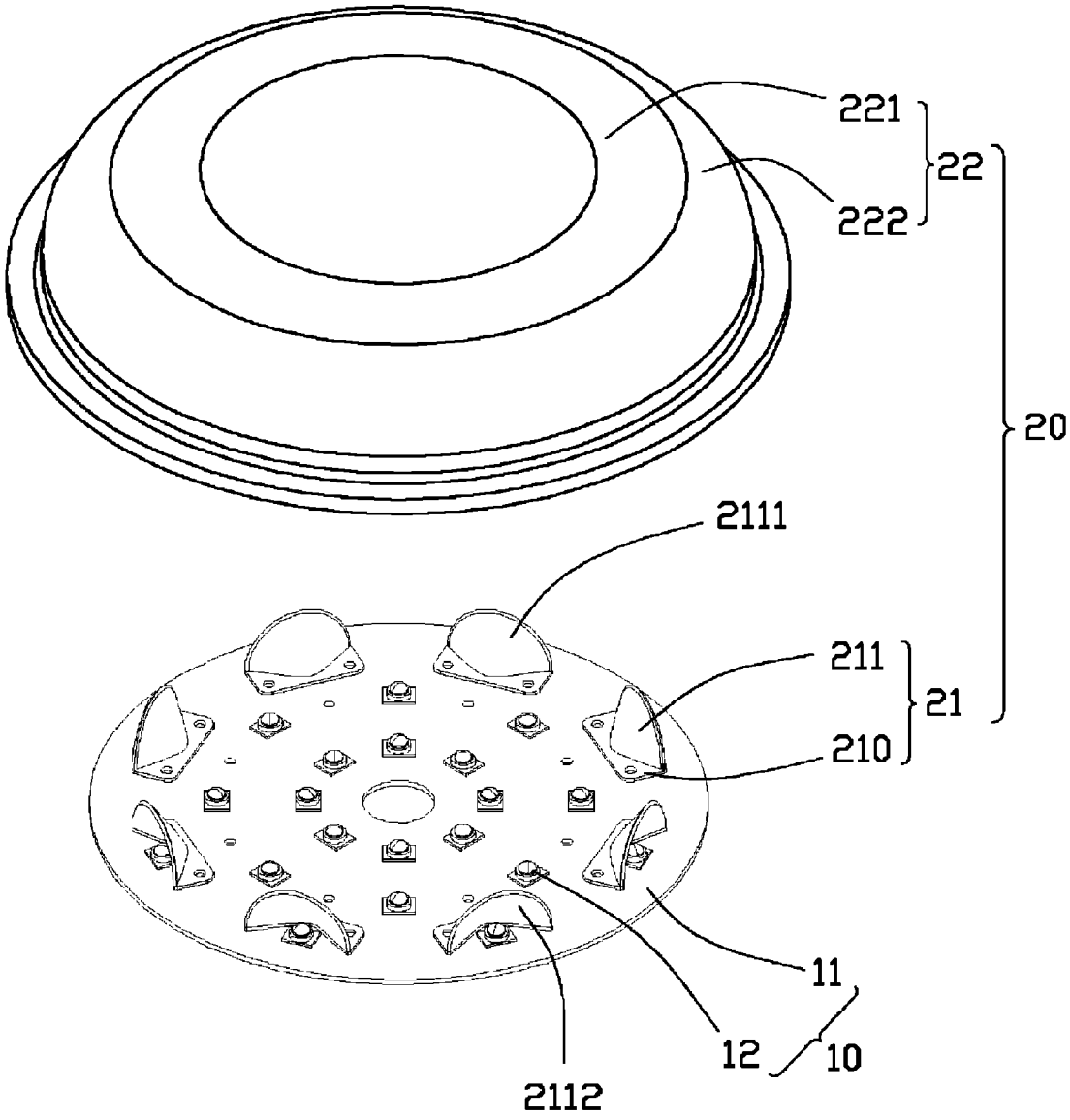
FIG. 2 is an isometric, exploded view of the LED lighting module of FIG. 1.

Referring to FIGS. 1-2, an LED lighting module includes a light source 10 and an optical system 20 cooperating with the light source 10. The light source 10 includes a printed circuit board 11, and a plurality of LEDs 12 mounted on a top side of the printed circuit board 11. The LEDs 12 each include an LED chip packaged with a transparent resin. That is, the transparent resin is a primary optical system; the optical system 20 is a secondary optical system. The optical system 20 functions to guide and adjust light emitting angles of the LEDs 12 to achieve a desired distribution of luminous intensity.

The LEDs 12 include a first group of LEDs 121 located in a main region of the top side of the printed circuit board 11, and a second group of LEDs 122 located near an edge region of the top side of the printed circuit board 11. That is, the first and second groups of LEDs 121, 122 are in the same side of the printed circuit board 11, and the second group of LEDs 122 surrounds the first group of LEDs 121. The first group of LEDs 121 is used to illuminate a main working area to which the top side of the printed circuit board 11 faces, and the second group of LEDs 122 is used to illuminate a periphery working area around the main working area. In the illustrated embodiment, the LEDs of the first group of LEDs 121 are arranged on a number of imaginary concentric circles, and the LEDs of the second group of LEDs 122 are arranged on one imaginary circle outside of the imaginary concentric circles of the first group of LEDs 121.

The optical system 20 includes a number reflectors 21 and a light transmission envelope 22. The reflectors 21 are secured to the edge region of the top side of the printed circuit board 11. The envelope 22 covers the LEDs 12 and the reflectors 21 therein. Each of the reflectors 21 corresponds to one LED of the second group of LEDs 122. The reflectors 21 are arranged on an imaginary circle between the imaginary circle of the second group of LEDs 122 and the outermost one of the imaginary circles of the first group of LEDs 121, which are concentric to each other. In detail, each of the reflectors 21 includes a seat 210 fixed on the printed circuit board 11 and a reflecting part 211 extending upwardly from an edge of the seat 210. The seat 210 includes a concave edge partially surrounding one LED of the second group of LEDs 122. The reflecting part 211 is an arc-shaped sheet and extends upwardly from the concave edge to partially surround the LED of the second group of LEDs 122, whereby the light generated by the LED can be reflected by the reflecting part 211. The reflecting parts 211 of the reflectors 21 each define an opening facing a corresponding LED 122 of the second group of LEDs 122, whereby the light generated by the LED of the second group of LEDs 122 can be reflected by the reflecting parts 211 of the reflectors 21 to illuminate the periphery working area below the bottom side of the printed circuit board 11.

The reflecting parts 211 of the reflectors 21 each have a convex inner reflecting surface 2111 facing the first group of LEDs 121 and a concave outer reflecting surface 2112 facing the second group of LEDs 122. The inner reflecting surface 2111 and the outer reflecting surface 2112 each can be a paraboloid surface, a spherical surface, an aspheric surface or an ellipsoid surface, and functions to reflect and adjust the distribution of luminous intensity of the light generated by the first group of LEDs 121 and the second group LEDs 122, respectively. Specifically, the light generated by the first group of LEDs 121 is mostly distributed at the main working area where the light emitting angle ranges from 0° to about 120°, and is little distributed at a glare region where the light emitting angle ranges from about 120° to about 180° where the glare easily occurs. In the main working area, the light has a high luminous intensity to thereby meet a practical illumination requirement. In the glare region, the light has a low luminous intensity to thereby weaken the glare intensity of the whole LED lighting module. The light generated by the second group of LEDs 122 is distributed at the periphery working area where the light emitting angle ranges larger than 180° (i.e., the area where the bottom side of printed circuit board 11 faces), and even reaches 210°. Therefore, the light emitting angle of the LED lighting module is larger than 180° to thereby achieve a large light emitting angle.

The reflectors 21 can be made of plastic or metallic material. According to practical requirement, the inner and outer reflecting surfaces 2111, 2112 can be surface treated to optimize the light reflection. For example, the inner and outer reflecting surfaces 2111, 2112 are treated to be diffuse, reflective surfaces by spraying or coating white reflecting material thereon; or the inner and outer reflecting surfaces 2111, 2112 are treated to be highly reflective surfaces by polishing or plating a metallic coating thereon.

The seat 210 of each of the reflectors 21 defines two thread holes (not labeled), the printed circuit board 11 defines two through holes (not shown) corresponding to the two thread holes, two screws (not shown) extend through the two through holes of the printed circuit board 11 to threadedly engage in the two thread holes of the seat 210 of each of the reflectors 21 to thereby secure the reflectors 21 to the printed circuit board 11.

The envelope 22 includes a main part 221 corresponding to the first group of LEDs 121 and a periphery part 222 corresponding to the second group of LEDs 122. The main part 221 is a circular flat sheet, and the periphery part 222 bends downwardly from a circumferential edge of the main part 221 to form an arc-shaped configuration. The main part 221 and the periphery part 222 each used to preferably guide the light out of the envelope 22. The periphery part 222 encloses the printed circuit board 11.

The envelope 22 can be made of glass, polycarbonate, polymethyl methacrylate or other suitable material. The envelope 22 can be treated to be frosted structure or transparent structure to achieve various light guide effect. The envelope 22 can be frosted by sandblasting, doping diffuse particles therein or adhering a diffuse film thereon. Preferably, an inner surface of the envelope 22 is processed by the sandblasting process or is adhered with a diffuse film. The diffuse particles are doped in a raw material such as the polycarbonate, and the raw material containing the diffuse particles undergoes an injection molding process to get the envelope 22 having the diffuse particles doped therein.

Figure 3:
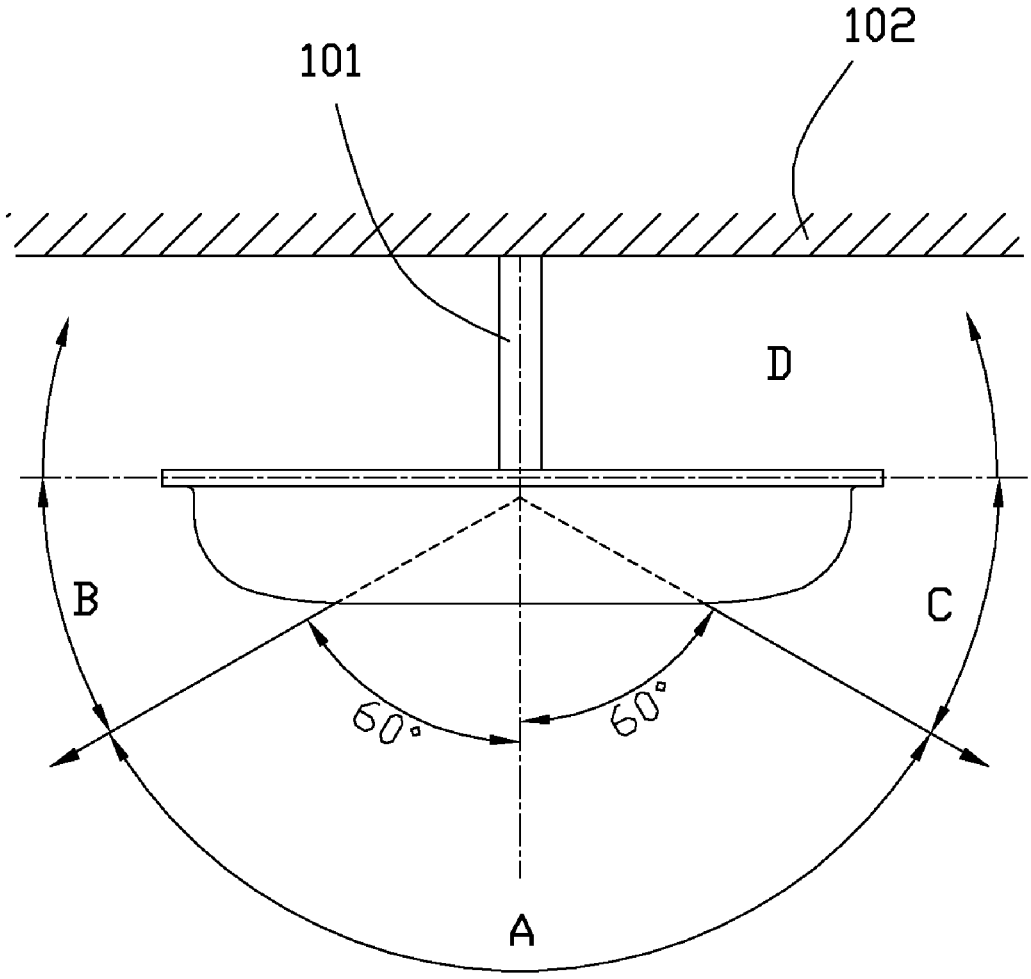
FIG. 3 is an illustrative view showing a distribution of luminous intensity of the LED lighting module of FIG. 1.

The above-described LED lighting module can cooperate with other structures to form various illumination devices. For example, the LED lighting module shown in FIG. 1 is inverted and secured to a ceiling 102 by a suspension rod 101, as shown in FIG. 3. Referring to FIG. 3, the LED lighting module has three illumination regions, that is, the main region (i.e., the light emitting angle of the LED lighting module ranges from 0° to about 60°, denoted by A), the glare region (i.e., the light emitting angle of the LED lighting module ranges from above 60° to about 90°, denoted by B and C), and the periphery region (i.e., the light emitting angle of the LED lighting module is larger than 90°, denoted by D). In operation, light generated by the first group of LEDs 121 is reflected by the inner reflecting surface 2111 of the reflectors 21 to illuminate the main region A and the glare region B, C; the light in the main region A has a high luminous intensity which can meet a practical illumination requirement, and the light in the glare region B, C has a low luminous intensity to thereby weaken the glare effect. The light generated by the second group of LEDs 122 is reflected by the outer reflecting surface 2112 of the reflectors 21 to illuminate the periphery region D.

Various configurations of the envelope 22 and the outer reflecting surfaces 2112 of the reflectors 21 can construct various LED lighting modules. There are three examples given below.

Figure 4:
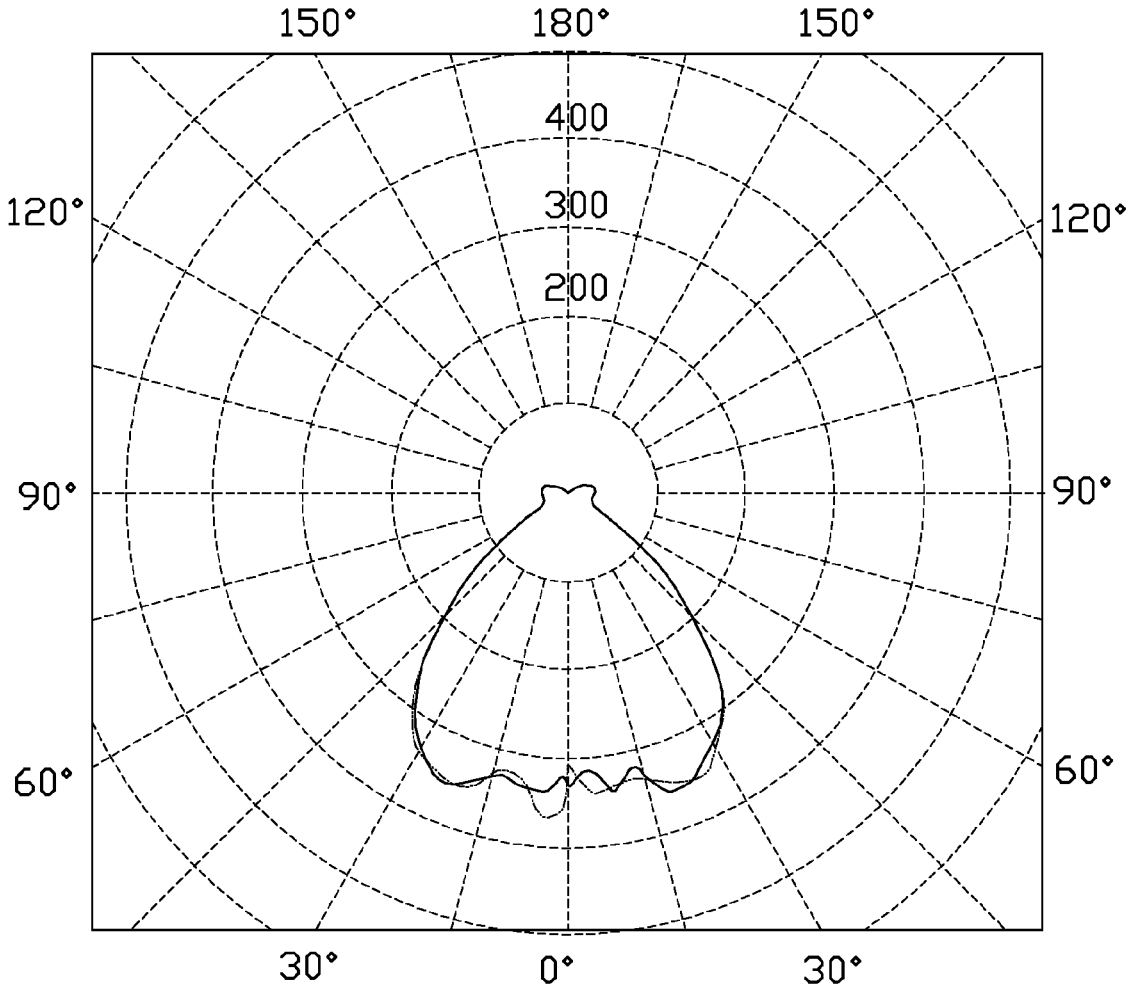
FIG. 4 is a distribution curve of luminous intensity of the LED lighting module of example 1 of the embodiment.

Example 1: The envelope 22 is a transparent structure, the outer reflecting surfaces 2112 of the reflectors 21 are white diffuse, reflective surfaces, and a distribution curve of luminous intensity of the LED lighting module of this example is shown in FIG. 4. As seen From FIG. 4, when the light emitting angle of the LED lighting module is less than 60° which is the main region, the luminous intensity is relatively high; when the light emitting angle ranges from 60° to 90° which is the glare region, the luminous intensity is relatively low; and when the light emitting angle is larger 90° (even is equal to 120°) which is the periphery region, the LED lighting module also has a certain luminous intensity. Particularly, in the periphery region, although the luminous intensity of the LED lighting module is relatively low, this low luminous intensity can meet practical requirement due to the LED lighting module and the ceiling 102 therebetween has a relatively short distance.

Figure 5:
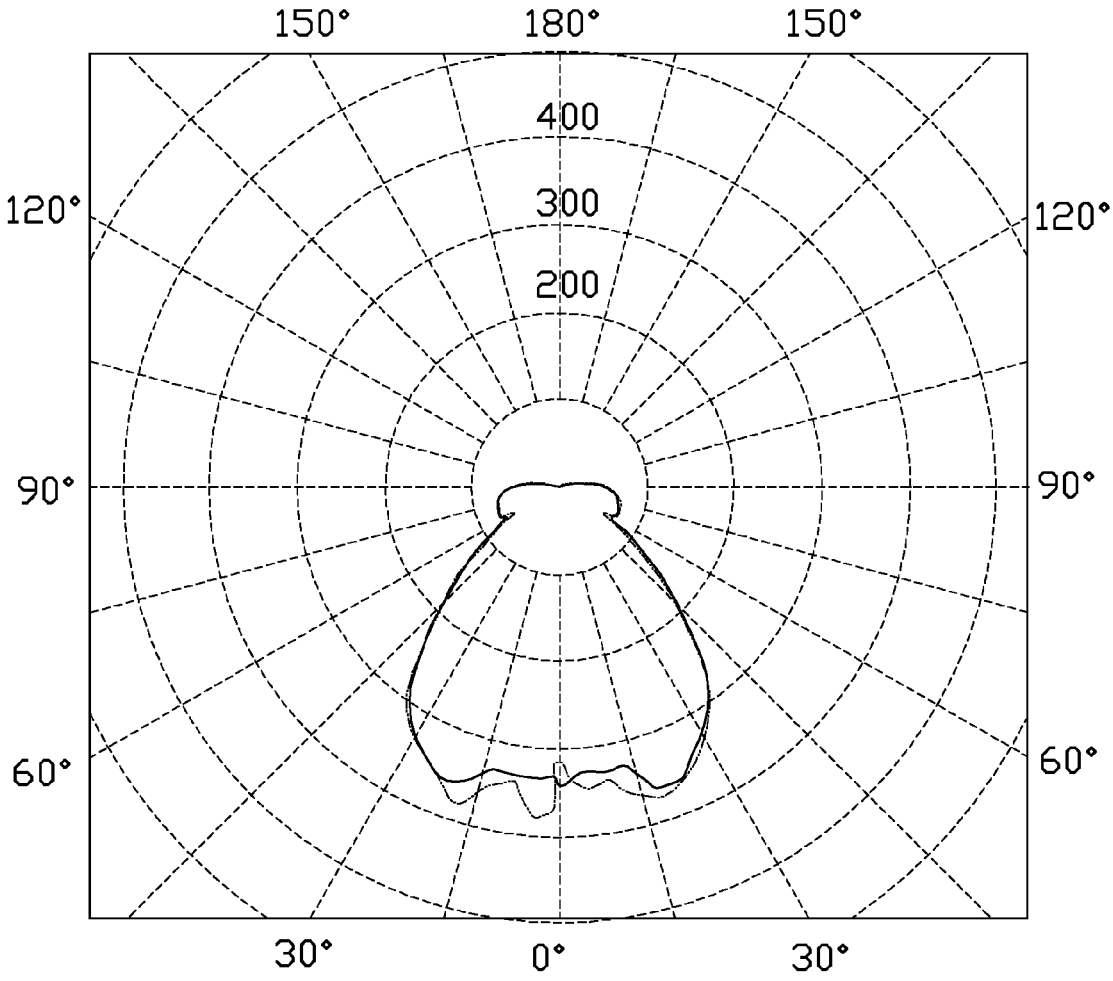
FIG. 5 is a distribution curve of luminous intensity of the LED lighting module of example 2 of the embodiment.

Example 2: The envelope 22 is a transparent structure, the outer reflecting surfaces 2112 of the reflectors 21 are highly reflective surfaces by plating aluminum thereon, and a distribution curve of luminous intensity of the LED lighting module of this example is shown in FIG. 5. The illumination performance of the LED lighting module of example 2 is similar to that of example 1.

Figure 6:
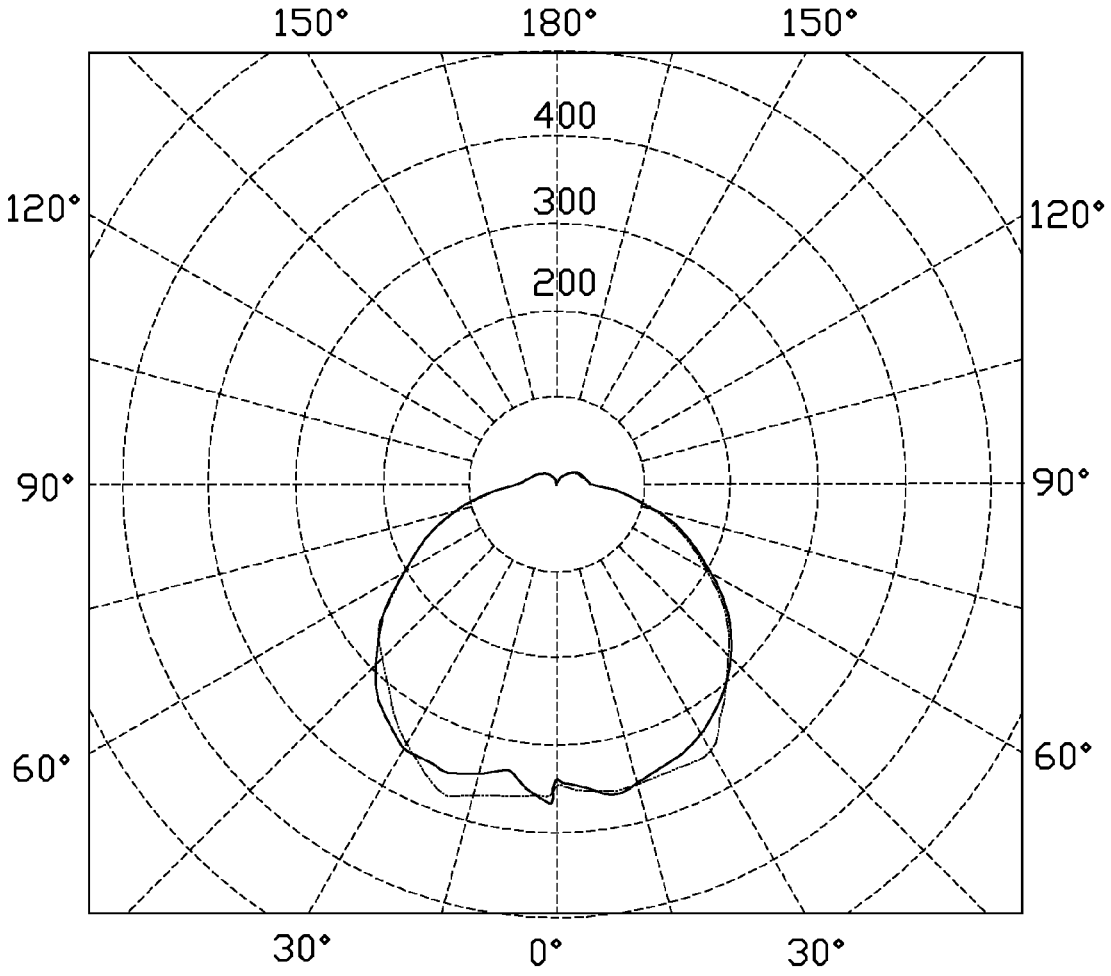
FIG. 6 is a distribution curve of luminous intensity of the LED lighting module of example 3 of the embodiment.

Example 3: The envelope 22 is a frosted structure, the outer reflecting surfaces 2112 of the reflectors 21 are highly reflective surfaces, and a distribution curve of luminous intensity of the LED lighting module of this example is shown in FIG. 6. The distribution curve of luminous intensity of the LED lighting module of example 3 is similar to a circle. That is, the luminous intensities of the LED lighting module are evenly distributed at various light emitting angles. Therefore, the LED lighting module of example 3 glows softly, and enables the user's eyes to be more comfortable.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED lighting module comprising:

a base;

a plurality of first LEDs disposed on a top side of the base; and a plurality of reflectors disposed on the top side of the base, wherein the reflectors correspond to the first LEDs, respectively, whereby light generated by the first LEDs illuminates an area to which a bottom side of the base faces.

2. The LED lighting module of claim 1, wherein the first LEDs are mounted to an edge region of the top side of the base.

3. The LED lighting module claim 2, further comprising a plurality of second LEDs disposed at a main region of the top side of the base, which is surrounded by the edge region and the reflectors.

4. The LED lighting module of claim 3, wherein the first LEDs are arranged on a first circular arrangement, the second LEDs are arranged on a plurality of second concentric circular arrangements inside of the first circular arrangement.

5. The LED lighting module of claim 4, wherein the reflectors are arranged on a circular arrangement between the first circular arrangement of the first LEDs and the outermost one of the second concentric circular arrangements of the second LEDs.

6. The LED lighting module of claim 5, wherein each of the reflectors comprises a seat fixed on the top side of the base and a reflecting part extending upwardly from an edge of the seat.

7. The LED lighting module of claim 6, wherein the reflecting part of each of the reflectors is an arc-shaped sheet partially surrounding one LED of the first LEDs, whereby the light generated by the LED can be reflected by the reflecting part.

8. The LED lighting module of claim 6, wherein the reflecting part of each of the reflectors has a convex inner reflecting surface facing a corresponding one of the first LEDs and a concave outer reflecting surface facing the second LEDs.

9. The LED lighting module of claim 8, wherein each of the inner and outer reflecting surfaces of each of the reflectors each is one of a paraboloid surface, a spherical surface, an aspheric surface and an ellipsoid surface.

10. The LED lighting module of claim 8, wherein each of the inner and outer reflecting surfaces of each of the reflectors each is one of a diffuse, reflective surface and a highly reflective surface.

11. The LED lighting module of claim 3, further comprising an envelope having a main part corresponding to the second LEDs and a periphery part corresponding to the first LEDs.

12. The LED lighting module of claim 11, wherein the envelope is a one of a frosted structure and a transparent structure.

13. The LED lighting module of claim 12, wherein the frosted structure is formed by one of sandblasting the envelope, doping diffuse particles in the envelope and adhering a diffuse film to the envelope.

14. An LED lighting module comprising:

a base;

a first group of LEDs disposed on a main region of a top side of the base;

a second group of LEDs disposed on an edge region of the top side of the base and surrounding the first group of LEDs;

a plurality of reflectors disposed on the top side of the base, wherein each of the reflectors corresponds to one LED of the second group of LEDs, whereby light generated by the second group of LEDs illuminates an area below a bottom side of the base.

15. The LED lighting module of claim 14, wherein the first group of LEDs are arranged on a plurality of first concentric circular arrangements, the second group of LEDs are arranged on a second circular arrangement.

16. The LED lighting module of claim 15, wherein the reflectors are arranged on a circular arrangement between the second circular arrangement of the second group of LEDs and the outermost circle of the first concentric circular arrangements of the first LEDs.

17. The LED lighting module of claim 16, wherein each of the reflectors comprises a seat fixed on the top side of the base and a reflecting part extending upwardly from an edge of the seat.

18. The LED lighting module of claim 17, wherein the reflecting part of each of the reflectors is an arc-shaped sheet partially surrounding one LED of the second group of LEDs, whereby the light generated by the one LED of the second group of LEDs can be reflected by the reflecting part.

* * * * *